US008544771B2

(12) United States Patent
Ganser

(10) Patent No.: US 8,544,771 B2
(45) Date of Patent: Oct. 1, 2013

(54) FUEL INJECTION VALVE FOR INTERNAL COMBUSTION ENGINES

(75) Inventor: Marco Ganser, Oberägeri (CH)

(73) Assignee: Ganser-Hydromag AG, Oberageri (CH)

( * ) Notice: Subject to any disclaimer, the term of this patent is extended or adjusted under 35 U.S.C. 154(b) by 954 days.

(21) Appl. No.: 12/280,983

(22) PCT Filed: Feb. 22, 2007

(86) PCT No.: PCT/CH2007/000091

§ 371 (c)(1),
(2), (4) Date: Aug. 27, 2008

(87) PCT Pub. No.: WO2007/098621

PCT Pub. Date: Sep. 7, 2007

(65) Prior Publication Data

US 2009/0065614 A1 Mar. 12, 2009

(30) Foreign Application Priority Data

Mar. 3, 2006 (CH) ..... 0340/06

(51) Int. Cl.
*B05B 1/30* (2006.01)

(52) U.S. Cl.
USPC ..... 239/584; 239/585.5

(58) Field of Classification Search
USPC ..... 239/584, 585.1–585.5, 88, 89, 91, 239/95, 533.2, 533.9, 533.11; 251/129.15, 251/129.21, 127
See application file for complete search history.

(56) References Cited

U.S. PATENT DOCUMENTS

| | | | | |
|---|---|---|---|---|
| 5,551,391 | A * | 9/1996 | Beck et al. | 123/305 |
| 5,655,716 | A | 8/1997 | Mathis | |
| 5,685,483 | A * | 11/1997 | Ganser | 239/89 |
| 5,842,640 | A * | 12/1998 | Ganser | 239/89 |
| 6,293,254 | B1 * | 9/2001 | Crofts et al. | 123/467 |
| 6,499,669 | B2 * | 12/2002 | Ganser | 239/96 |
| 2003/0141472 | A1 | 7/2003 | Mattes | |
| 2005/0242211 | A1 | 11/2005 | Funai et al. | |

FOREIGN PATENT DOCUMENTS

| | | | |
|---|---|---|---|
| DE | 37 00 687 | A1 | 7/1987 |
| DE | 44 06 901 | A1 | 9/1995 |
| DE | 100 30 119 | A1 | 12/2000 |
| DE | 102 54 750 | A1 | 6/2004 |

(Continued)

OTHER PUBLICATIONS

International Search Report of International Application No. PCT/CH2007/000091, mailed on Jun. 20, 2007.

(Continued)

*Primary Examiner* — Davis Hwu
(74) *Attorney, Agent, or Firm* — Abe Hershkovitz; Hershkovitz & Associates PLLC

(57) ABSTRACT

A control device (52) of a fuel injection valve has a mushroom-shaped intermediate valve member (56) which is guided with a sliding fit (58') in a first intermediate plate (12). An injection valve member (28), which has a control piston (28'), for opening and closing injection openings in order to realize intermittent injection processes defines a control space (54) together with a guide sleeve (36) and the lower face (12*a*) of the first intermediate plate (12). A second intermediate plate (14) is situated between the first intermediate plate (12) and a housing body (10), and has a valve space (70) which is hydraulically connected to the end side of a shank (58) of the mushroom-shaped intermediate valve member (56).

22 Claims, 13 Drawing Sheets

(56) References Cited

FOREIGN PATENT DOCUMENTS

| | | | |
|---|---|---|---|
| DE | 10 2005 020048 | A1 | 11/2005 |
| EP | 0 976 924 | A2 | 2/2000 |
| GB | 2185530 | A | 7/1987 |
| WO | 02/053904 | A1 | 7/2002 |
| WO | 2005/019637 | A1 | 3/2005 |

OTHER PUBLICATIONS

International Preliminary Examination Report (in German) of International Application No. PCT/CH2007/000091, mailed on Jun. 17, 2008.

International Preliminary Examination Report (in English) of International Application No. PCT/CH2007/000091, mailed on Jun. 17, 2008.

* cited by examiner

FUEL INJECTION VALVE FOR INTERNAL COMBUSTION ENGINES

The present invention relates to a fuel injection valve for the intermittent injection of fuel into the combustion space of an internal combustion engine, according to the preamble of patent claim 1, said fuel injection valve being used preferably in diesel engines.

Fuel injection valves of this type are known, for example, from WO 2005/019637 A1. Further fuel injection valves are disclosed, for example, in WO 02/053904 A1, EP 0 976 924 B1 and DE 37 00 687 A1.

WO 02/053904 A1 shows an injection valve with a piezoelectric actuator which controls an outlet of a valve space. The valve space is connected to a control space via an outlet throttle passage, and this control space is connected to a high-pressure space of the injection valve via an inlet throttle passage. By the pressure of the control space being lowered, the end face of a control piston of the injection valve member is relieved, with the result that the injection valve member can be opened and the injection of fuel can take place. To close the injection valve member at the end of injection, a further passage connected to the high-pressure space can be opened by the piezoelectric actuator, with the result that the inflow of fuel into the control space can also take place through the outlet throttle passage in addition to the inlet throttle passage. This solution is highly complicated, since in order to achieve an exact opening movement, always the same in many injection valves, of the injection valve member, which must be case in a series of structurally identical injection valves, firstly an accurate coordination of the throughflow characteristics both of the inlet and of the outlet throttle passage must be obtained. Secondly, in addition, the further passage also has to be opened in a directed manner by the piezoelectric actuator, in order to organize the closing of the injection valve member at the end of injection at least so quickly that the combustion of the engine cylinder assigned to the injection valve does not suffer too greatly from this. However, since the additional inflow to implement the closing movement of the injection valve member has to flow through the outlet throttle passage, it is throttled and the additional cross section opened by the actuator is utilized to only a slight extent.

In the injection valve disclosed in EP 0 976 924 B1, similarly to the injection valve known from WO 02/053904 A1, an inlet and an outlet throttle passage having the same function and the same disadvantages are present. This solution is preferable inasmuch as, when the valve space is being opened, the actuator valve member simultaneously closes the additional further passage. This function corresponds to that of a three-way valve and has therefore been known for a long time in hydraulics. The further passage is configured as a flat seat, whereas the outlet from the valve space is configured as a conical seat. On account of the small stroke of the valve member actuated by the piezoactuator, the conical seat presents the difficulty of obtaining identical strokes in all the injection valves of a series. Furthermore, the alignment of the valve member of mushroom-shaped type presents problems, since the flat seat is arranged in a first intermediate plate and the conical seat in a second intermediate plate of the injection valve, the valve member being guided radially in the first plate. The two intermediate plates therefore have to be positioned exactly with respect to one another, otherwise the leaktightness of at least one of the seats is prejudiced.

In the injection system known from DE 37 00 687 A1, during injection a solenoid valve, when actuated, connects a duct to a return line. Between the duct and a control space is located a nonreturn valve designed as a wafer with a throttle bore. During the opening movement of the injection valve member, the control space can be emptied into the duct solely via the throttle bore of the nonreturn valve wafer, thus leading to a controllability of the opening movement of the injection valve member. During the closing of the injection valve member, the nonreturn valve wafer opens such that the closing movement of the injection valve member can take place more quickly than the opening movement. In this injection system, too, the fuel volume flow for closing the injection valve member has to flow solely through a throttle which connects the duct to a pressure accumulator of the injection system via an annular space. This throttle has a small cross section and is coordinated with a further throttle which is located at the outlet of the duct. The opening and the closing movement of the injection valve member are consequently controlled by three throttle bores which have to be coordinated exactly with one another.

A fuel injection valve is known from WO 2005/019637 A1 and particularly from FIG. 9, in which fuel injection valve the opening movement of the injection valve member can be determined by the design of a throttle bore in a similar way to the injection valve disclosed in DE 37 00 687 A1. To terminate the injection operation, the piezoactuator of a pilot valve has to be expanded, the result of this being that a high-pressure duct connected to the high-pressure inlet is released by a control body. The released relatively large cross section causes a high fuel inflow into the control space and consequently a particularly rapid and advantageous operation to close the injection valve member. To release the control body, a transmission pin is pressed onto the end face of the control body by a pilot valve pin of the actuator.

This solution has the disadvantage that the piezoactuator has to be expanded during the operation of closing the injection valve member. In this state, current is applied to the piezoactuator. Since the injection duration amounts to only 5% or less of the duration between two injections, the piezoactuator is almost continuously under an electrical voltage. Furthermore, in this known solution, the position of the throttle bore which determines the opening movement of the injection valve member is unfavorable, since it is located far away from the control space.

The object of the present invention is to provide a fuel injection valve of particularly simple construction, in which, at minimal outlay in structural terms, both a controllability of the opening movement of the injection valve member and a rapid closing operation of the injection valve member can be achieved. Furthermore, in the fuel injection valve of the present invention, the implementation of multiple injections with a very short time interval is to be achievable without difficulty.

While a control space and a valve space are continuously connected to one another via an exact throttle passage, an intermediate valve otherwise separates these two spaces continuously from one another. The throttle passage is arranged directly adjacently to the control space. A passage connected to the high-pressure space of the injection valve and leading into the control space and having a large cross section, as compared with the cross section of the throttle passage, is controlled by the intermediate valve. Since the cross section of the outflow, controlled by an electrical actuator arrangement, from the valve space may also be substantially larger than the cross section of the throttle passage, the opening movement of the injection valve member is dependent essentially solely on the cross section of the throttle passage. During the closing of the outflow from the valve space by means of the actuator arrangement, the intermediate valve opens quickly and releases the passage of large cross section connected to the high-pressure space, thus bringing about a rapid termination of the injection operation.

In a preferred further refinement of the present invention, a flat-seat valve member acting as a 2/3-way valve is used, which can execute a specific small stroke in a second intermediate plate in the valve space. In a preferred embodiment, the flat-seat valve member has two flat seats. In the dead state of a piezoactuator advantageously used for actuating the flat-seat valve member, the flat-seat valve member, by means of a first valve seat, closes off a connection between the valve space and the low-pressure fuel return and at the same time releases a high-pressure duct which is located in a first intermediate plate and is connected to the high-pressure inlet and which has a relatively large unthrottled cross section. The throughflow cross section between the flat-seat valve member and the high-pressure inlet, that is to say the valve flat seat, is dependent on the distance, hence on the stroke, of the flat-seat valve member and mostly constitutes a narrower passage than that of the high-pressure duct.

In the live state of the piezoactuator when the latter expands, the flat-seat valve member is pressed onto the high-pressure duct and closes the valve passage by means of its valve flat seat, the low-pressure outlet at the same time being released. A second connecting duct of relatively large cross section in the first intermediate plate connects the control space to the valve space.

Terms such as "relatively large cross section" or "cross section larger than" and the like relate to the cross section of said throttle passage, and such cross sections are preferably at least twice as large, but mostly 5 or 10 times larger, or even larger, than the cross section of the throttle passage.

Particularly preferred embodiments are defined in the further patent claims.

The abovementioned and further advantages of the present invention are explained in more detail by means of preferred embodiments which are illustrated in the drawings and are described below. In the drawings, purely diagrammatically, FIG. 1 shows a longitudinal section of a fuel injection valve according to the present invention;

Figure 1:
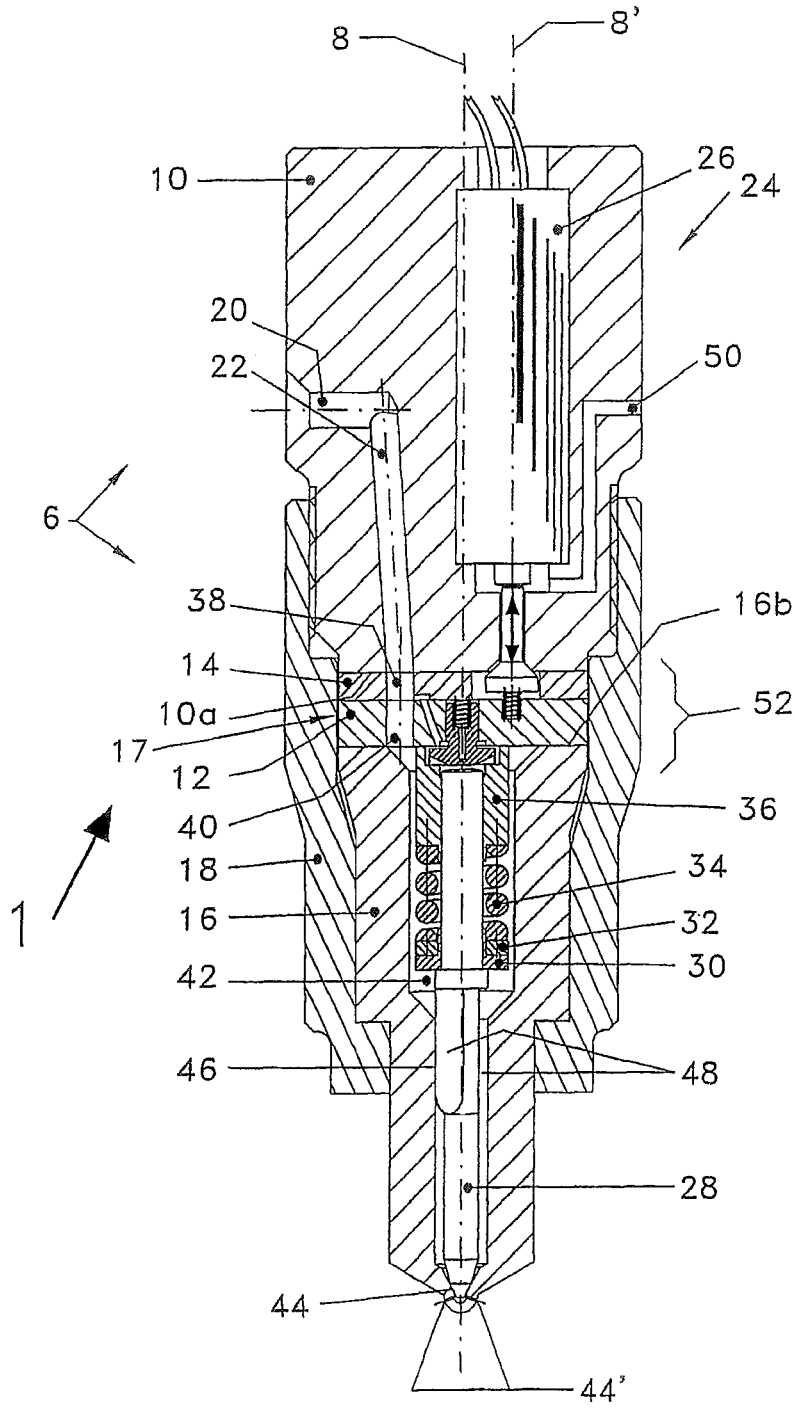

FIG. 1 shows a fuel injection valve 1 which is intended for the intermittent injection of fuel into the combustion space of an internal combustion engine. It has an elongate circular-cylindrical and stepped housing 6, the housing axis of which is designated by 8. The housing 6 consists of a housing body 10, of a first intermediate plate 12, of a second intermediate plate 14 and of a nozzle body 16. The first intermediate plate 12 and the second intermediate plate 14 form an intermediate part 17. The intermediate plates 12 and 14 and the nozzle body 16 are tensioned together, by means of a tension nut 18 designed as a union nut, in a leaktight manner with respect to one another and with respect to a lower face 10*a* of the housing body 10. The first intermediate plate 12 in this case bears against the nozzle body 16 and the second intermediate plate 14 against the housing body 10.

A high-pressure fuel inlet 20, designed as a high-pressure supply bore, of the fuel injection valve 1 is connected in a known way to a fuel feed which supplies the fuel injection valve 1 with fuel under very high pressure of, for example, up to 1800 bar or higher. The high-pressure fuel inlet 20 issues laterally into the housing body 10, but could also be manufactured, more or less parallel to the housing axis 8, from above in the housing body 10. The high-pressure fuel inlet 20 has issuing into it a longitudinal bore 22 which is likewise manufactured in the housing body 10 and which issues at the other end into the lower face 10*a* of the housing body 10.

Diametrically opposite the longitudinal bore 22, and on an actuator axis 8' which is axially offset with respect to the housing axis 8, is located an actuator arrangement 24 which is preferably designed as a piezoactuator 26 and could alternatively be designed as an electromagnetic actuator.

Located in a high-pressure space 42 of the nozzle body 16 are a needle-shaped injection valve member 28, a supporting cuff 30, a washer 32, a compression spring 34 and a guide sleeve 36. The compression spring 34 is supported on the injection valve member 28 via the washer and supporting cuff 30.

A bore 38 through the second intermediate plate 14 and a bore 40 through the first intermediate plate 12 connect the longitudinal bore 22 to the high-pressure space 42. This high-pressure space 42 extends from that end face 16*b* of the nozzle body 16 which faces the intermediate plates 12, 14 as far as an injection valve seat 44. Downstream of the injection valve seat 44, the nozzle body has injection orifices 44'. The injection valve member 28 has a radial guide 46 with respect to the nozzle body 16, which radial guide is interrupted by ground faces 48 of the injection valve member 28 for the hydraulically virtually resistanceless supply of high-pressure fuel to the injection valve seat 44.

Located in the first and the second intermediate plate 12 and 14 is a hydraulic control device 52 for controlling the opening and rapid closing movements of the injection valve member 28 during the injection operation. The control device 52 of the fuel injection valve 1 is illustrated and described in detail in connection with FIG. 2. A low-pressure fuel return 50 relieves fuel for the control of the movements of the injection valve member and leads this fuel away from the fuel injection valve 1.

The description of the embodiments shown in FIGS. 2-8 uses the same reference symbols for the corresponding parts as in connection with the description of the fuel injection valve 1 shown in FIG. 1. Further, only the differences from the fuel injection valve 1 shown in FIG. 1 or from exemplary embodiments already described above are presented below.

Figure 2:
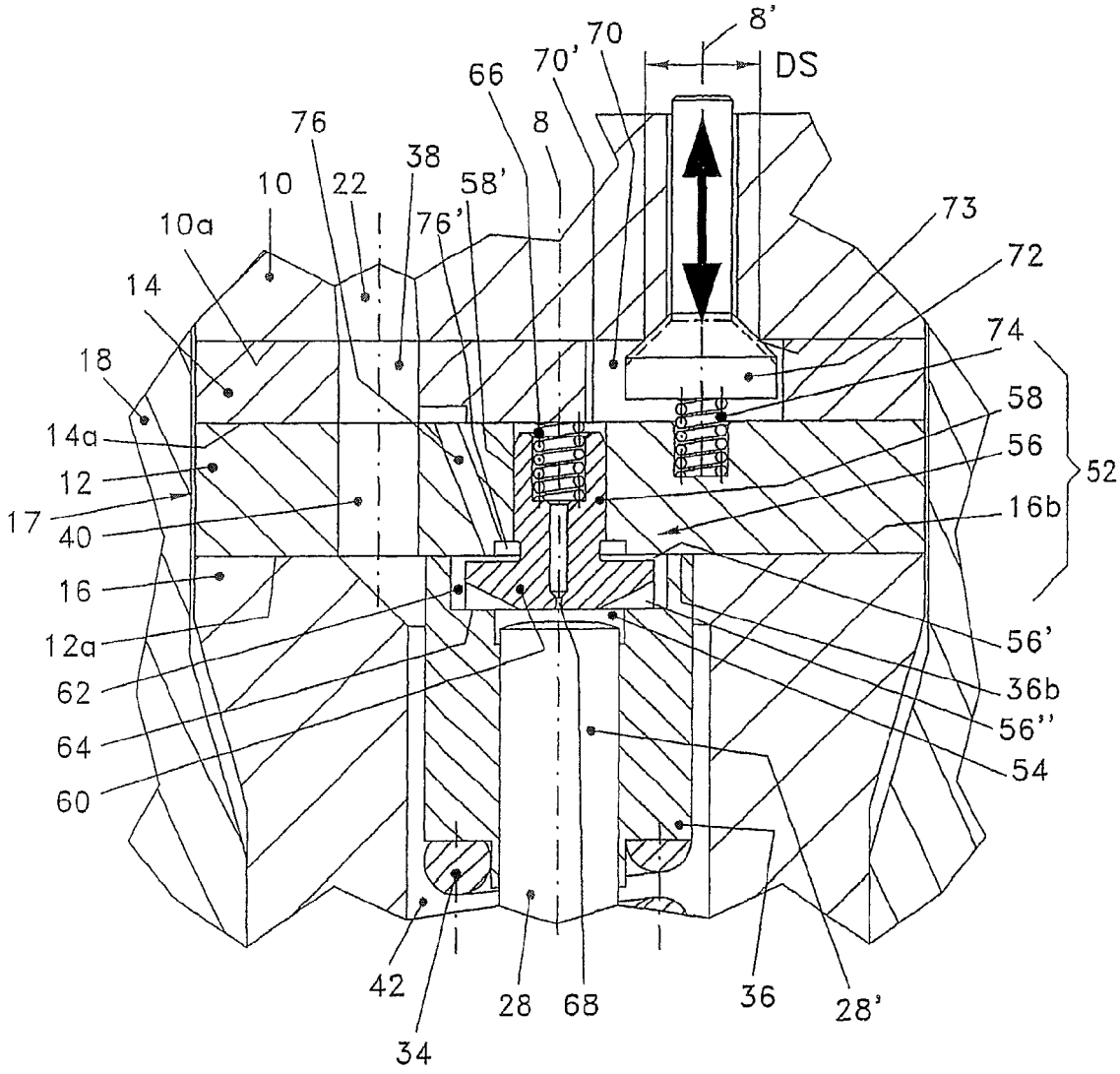
FIG. 2 shows, in longitudinal section and in an enlarged illustration, a partial section of the fuel injection valve according to the invention from FIG. 1 with its control device for controlling the opening and rapid closing movement of the injection valve member.

FIG. 2 shows, in longitudinal section and in an enlarged illustration, part of the fuel injection valve 1 according to the invention from FIG. 1 with its control device 52 for controlling the opening and rapid closing movement of the injection valve member such as it occurs in the intermission time between two injection operations.

A control piston 28' of the injection valve member 28 is mounted with a close sliding fit in the guide sleeve 36 so as to be guided radially and so as to be axially displaceable. It delimits, together with the guide sleeve 36, a control space 54, the end face 36*b* of which guide sleeve 36 is pressed sealingly and statically into bearing contact against a lower face 12*a* of the first intermediate plate 12 by the spring 34. A shank 58 of a mushroom-shaped intermediate valve member 56 standing on its head 60 engages into an axially continuous orifice of the first intermediate plate 12 and is guided on the latter with a close sliding fit 58' The head 60 of the intermediate valve member 56 is located axially displaceably in a clearance 62 of the guide sleeve 36. The clearance 62 is permanently connected hydraulically to the control space 54 by means of radial passages 56" in the head 60 and is therefore part of the control space 54. The head 60 is pressed against a shoulder 64 of the guide sleeve 36 by a small compression spring 66 supported on a lower face 14*a* of the second intermediate plate 14.

An exact throttle passage 68 of the intermediate valve member 56 connects the control space 54 permanently to a valve space 70 in the second intermediate plate 14; a recess passing through the second intermediate plate 14 and delimited by the first intermediate plate 12 and the housing body 10 forms the valve space 70. The valve space 70 is connected hydraulically to the rear side of the intermediate valve member 56 via a passage 70'; the small space in the continuous orifice of the first intermediate plate 12 on the rear side of the intermediate valve member 56 thus forms hydraulically a part of the valve space 70. According to FIG. 2, the throttle passage 68 is located directly adjacently to the control space 54, but could alternatively be manufactured, countersunk, along the hydraulic connecting bore passing axially through the intermediate valve member 56 or at the other end of this connecting bore in the shank 58, this having no influence on the functioning of the fuel injection valve 1.

Located in the valve space 70 is an actuator valve member 72 which is actuated by the piezoactuator 26 and which in its closed position bears sealingly with its conical sealing face against an annular valve seat DS formed on the housing body 10. The valve seat DS is formed by the mouth of an outlet passage 73 formed in the housing body 10; this outlet passage 73 leads to the low-pressure fuel return 50. An actuator valve member spring 74 exerts on the actuator valve member 72 in the direction of the valve seat DS a spring force which is constant, but is low in comparison with the fuel pressure force.

A bore 76 of relatively large cross section in the first intermediate plate 12 connects the control space 54 to the bore 38 via a lateral passage in the second intermediate plate 14. With the intermediate valve 56' closed, this connection is interrupted, the intermediate valve 56', in its open position, forming a circular-cylindrical passage. The lateral passage may alternatively be manufactured in the first intermediate plate 12.

The dimensions of the abovementioned outlet passage, of the bore or of the throttle passage amount, for example, to 0.20 mm for the throttle passage 68, to 0.08 mm for the bore 76 and to 1.3 mm for the valve seat DS of the actuator valve member 72 in the case of a full opening stroke of the actuator valve member 72 of approximately 0.025 mm. The latter corresponds to an outlet throttle passage 73 conforming to a bore with a diameter of approximately 0.36 mm, all these values being merely indicative. Said values show that the sole essential control cross section, which determines the opening movement of the injection valve member 28 in the case of a full opening stroke of the actuator valve member 72, is formed by the throttle passage 68.

The fuel injection valve 1 functions as follows: when current is applied to the piezoactuator 26, the latter expands and, by means of a downward movement of the actuator valve member 72, opens the valve seat DS and therefore the outlet passage 73. This position of the actuator valve member 72 is shown in FIG. 2 by a dashed line. The fuel pressure in the valve space 70 falls rapidly. The mushroom-shaped intermediate valve member 56 is thereby moved in the upward direction away from its bearing contact on the shoulder 64. Since the intermediate valve 56' is still open, fuel flows from the bore 76 into the control space 54 until the intermediate valve 56 is closed, this taking place when the flat upper part of the head 60 comes to bear against the lower face 12*a*. At this time point, the pressure in the control space 54 has fallen a little. Also, because of the close sliding fit 58' which gives rise between the control space 54 and the valve space 70 to a hydraulic separation point constantly present, with the exception of a slight leakage which is insignificant for the separating function, only very little fuel can pass into the valve space 70 where the pressure has already fallen sharply at this time point. Then, with the intermediate valve 56 closed, the pressure can also fall more sharply in the control space 54 on account of the emptying of fuel through the throttle passage 68. This causes a movement of the injection valve member 28 away from the injection valve seat 44, with the result that fuel under high pressure flows from the high-pressure space 42 to the injection orifices 44' via the injection valve seat 44 and the injection operation can commence. When the piezoactuator 26 is completely dead, the actuator valve member 72, by virtue of its upward movement, closes off the outlet passage 73. A rapid pressure compensation between the control space 54 and the valve space 70 thereby takes place, the effect of this being that the intermediate valve member 56 moves downward again on account of the system pressure force in a groove 76' connected to the bore 76, running around the shank 58 and open toward the head 60, and, in a small fraction, due to the force of the spring 66 and opens the intermediate valve seat 56' again. The injection valve member 28 is then moved quickly in the direction of the injection valve seat 44 until the injection operation is interrupted.

To implement separate preinjections or post-injections with a main injection between them and with very short time intervals between the individual injections, the intermediate valve member 56, by current being applied once more to the piezoactuator 26, can be moved in the closing direction of the intermediate valve 56' again even during the closing movement of the injection valve member 28, since the control space 54 and the distribution space 70 are virtually separated hydraulically due to the sliding fit 58. Subsequent injection can directly follow the end of the preceding injection, and the spacing between the individual separate injections can be shortened virtually to zero. Since the switchable cross section of the intermediate valve 56' is substantially larger than that of the throttle passage 68, this control device 52 according to the invention can be used to control both small fuel injection valves 1, such as, for example, for applications in passenger car or truck engines, and much larger fuel injection valves which are employed, for example, in locomotives, earth moving machines, current generation plants and ships.

Figure 3:
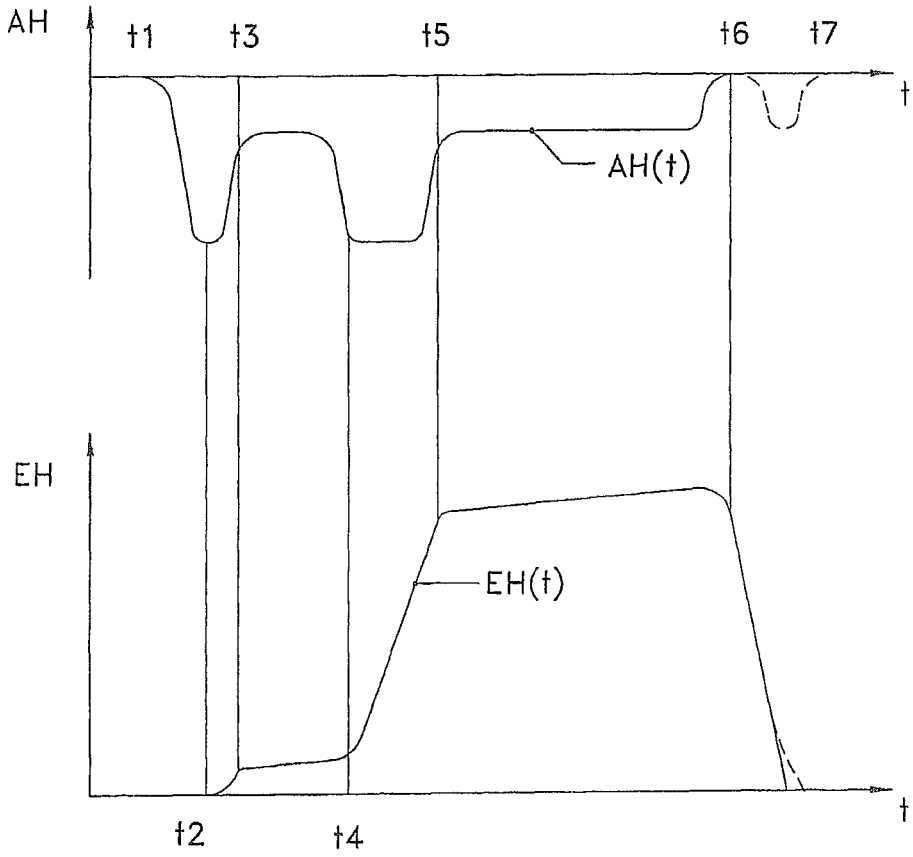
FIG. 3 shows a graph with the profiles of the movements of the actuator valve member and of the injection valve member of the fuel injection valve during an injection operation with a stepped opening movement of the injection valve member.

FIG. 3 shows the profile of the movement of the injection valve member 28 in the situation where the actuator valve member 72 assumes a position between its maximum open and its closed position during time segments of an unseparated, but stepped injection operation. The time profile of this actuator valve member stroke, designated as "AH", is illustrated in the upper graph of FIG. 3 as AH(t) such that a movement of the actuator valve member in the downward direction (according to the illustration of FIG. 2) opens or further opens the outlet passage 73. The injection valve member stroke time profile is designated as EH(t). The scales of AH and EH are different, since, as already mentioned, the full opening stroke of the actuator valve member 72 is of the order of 0.025 mm and the full opening stroke EH of the injection valve member amounts to between 0.20 mm and above 1.0 mm, depending on the engine size of a specific application.

At time point t1, current is applied to the piezoactuator 26, and the actuator valve member 72 is opened, so that, at t2, the opening movement of the injection valve member 28 commences. Between t2 and t3, the injection valve member 28 opens quickly, but covers only a short distance, since the application of current to the piezoactuator 26 is cancelled and therefore the actuator valve member 72 reduces the opening stroke to an extent such that the remaining outlet passage cross section likewise acts as a throttle. The opening speed of the injection valve member is thereby held, greatly reduced, until current is applied fully to the piezoactuator again and the full speed of the opening stroke is restored, this being the situation at t4. The injection valve member 28 thereafter opens again quickly up to t5 and its opening is controlled by the throttle passage 68. It is therefore possible to implement a stepped injection profile.

The profile of EH(t) shown occurs after the time t5 when the injection valve member 28 possesses no mechanical stroke stop or it does not reach any mechanical stroke stop even during a full-load injection operation. This is therefore an alternative possibility which functions without a mechanical stroke stop. It is possible, by reducing the actuator valve member stroke once more, in a similar way to between t3 and t4, to reduce again the opening speed of the injection valve member 28, starting from the stroke EH, present at t5, which corresponds to a full opening stroke of a fuel injection valve with a mechanical stroke stop. It is thereby possible to keep the maximum value of the stroke EH prior to the commencement of the closing operation of the injection valve member 28 within limits, even when the injection operation lasts a long time. This condition occurs particularly in fuel injection valves for large diesel engines.

At time point t6, the actuator valve member 72 is in the closing position. Between the time t6 and t7, therefore, the injection valve member 28 closes and the stroke EH(t) quickly approaches zero. When current is briefly applied to the piezoactuator 26 once more before the injection valve member 28 reaches the injection valve seat 44, the impact speed of the latter on the injection valve seat 44 can be reduced to an extent such that insignificant seat stress and consequently, should this be a critical condition, a longer service life of the injection valve seat 44 are achieved. The profiles of AH(t) and EH(t) for this situation are illustrated by dashes.

Figure 4:
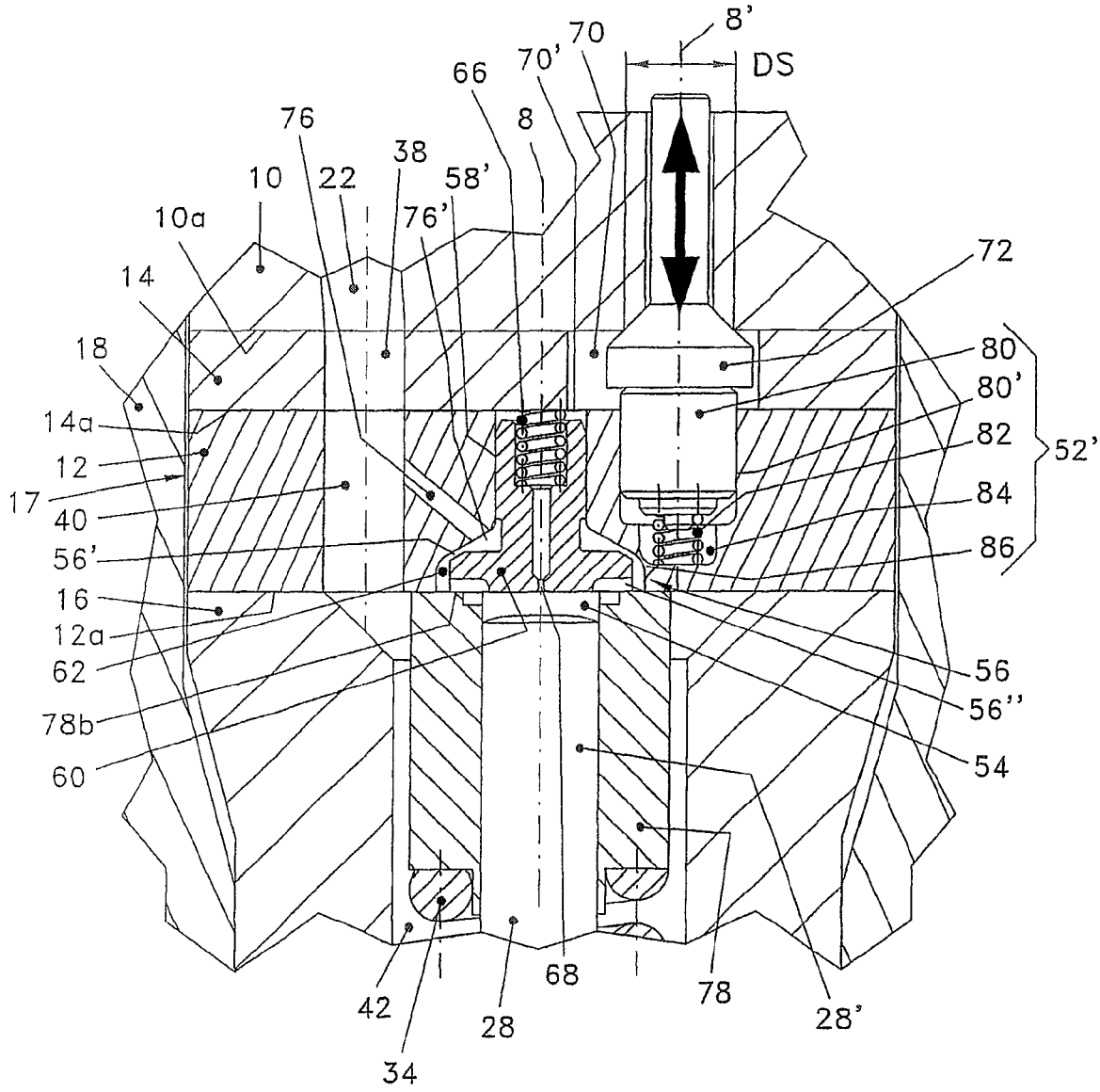
FIG. 4 shows, in longitudinal section and in an enlarged illustration, a partial section of a first alternative design variant of the control device of the fuel injection valve from FIG. 1.

FIG. 4 shows, in longitudinal section and in an enlarged illustration, a partial section of a first alternative design variant of a control device 52' of the fuel injection valve 1. The mushroom-shaped intermediate valve member 56 is countersunk completely in the first intermediate plate 12 and, together with the first intermediate plate 12, forms an intermediate valve 56' with a conical seat. The shoulder 64 of FIG. 2, offset with respect to the end face 36*b* of the guide sleeve 36, is dispensed with. The guide sleeve 78 of FIG. 4 has a planar end face 78*b* which both, together with the lower face 12*a* of the first intermediate plate 12, seals off the control space 54 radially with respect to the high-pressure space 42 and forms the stop for the head 60 of the intermediate valve member 56. The bore 76 issues directly into the bore 40. The intermediate valve member 56 and the first intermediate plate 12 can consequently form a structural unit having a coordinated stroke of the intermediate valve member 56. Alternatively, these two intermediate plates 12 and 14 forming the intermediate part 17 could also consist of a single workpiece, and this could likewise be implemented in FIGS. 1 and 2.

The embodiment according to FIG. 4 accordingly has a piston element 80. This arrangement could also be employed in the variant of FIG. 2. On the other hand, the variant of FIG. 4 could also be implemented without this piston element 80. The piston element 80 is guided with a relatively close sliding fit 80' in a blind hole-like recess in the first intermediate plate 12. A small compression spring 82 presses the piston element 80 constantly against the underside of the actuator valve member 72. A space 84, in which the compression spring 82 is located and which is delimited by the underside of the piston element 80, is permanently connected hydraulically to the control space 54 by means of a passage 86 having the clearance 62 and via the passages 56" in the head 60 of the intermediate valve member 56.

The functioning of the arrangement of the intermediate valve member 56 with a conical valve seat is similar to that of FIG. 2. The functioning of the piston element 80 is as follows: When the actuator valve member 72 is pressed downward by the piezoactuator 26, the piston element 80 copies the movement. The piston element 80 thereby increases the volume of the valve space 70 and at the same time, by its pumping action, reduces the volume of the space 84. The two together cause a more rapid closing of the intermediate valve 56', since the intermediate valve member 56 is induced to execute a more rapid movement in the upward direction. Conversely, during a movement of the actuator valve member 72 in the upward direction, the piston element 80 causes an increase in volume of the space 84 and at the same time a pumping action in the valve space 70. This brings about a more rapid response of the intermediate valve member 56 during the opening of the intermediate valve 56'. The piston element 80 thus assists a particularly rapid response of the intermediate valve member 56.

Figure 5:
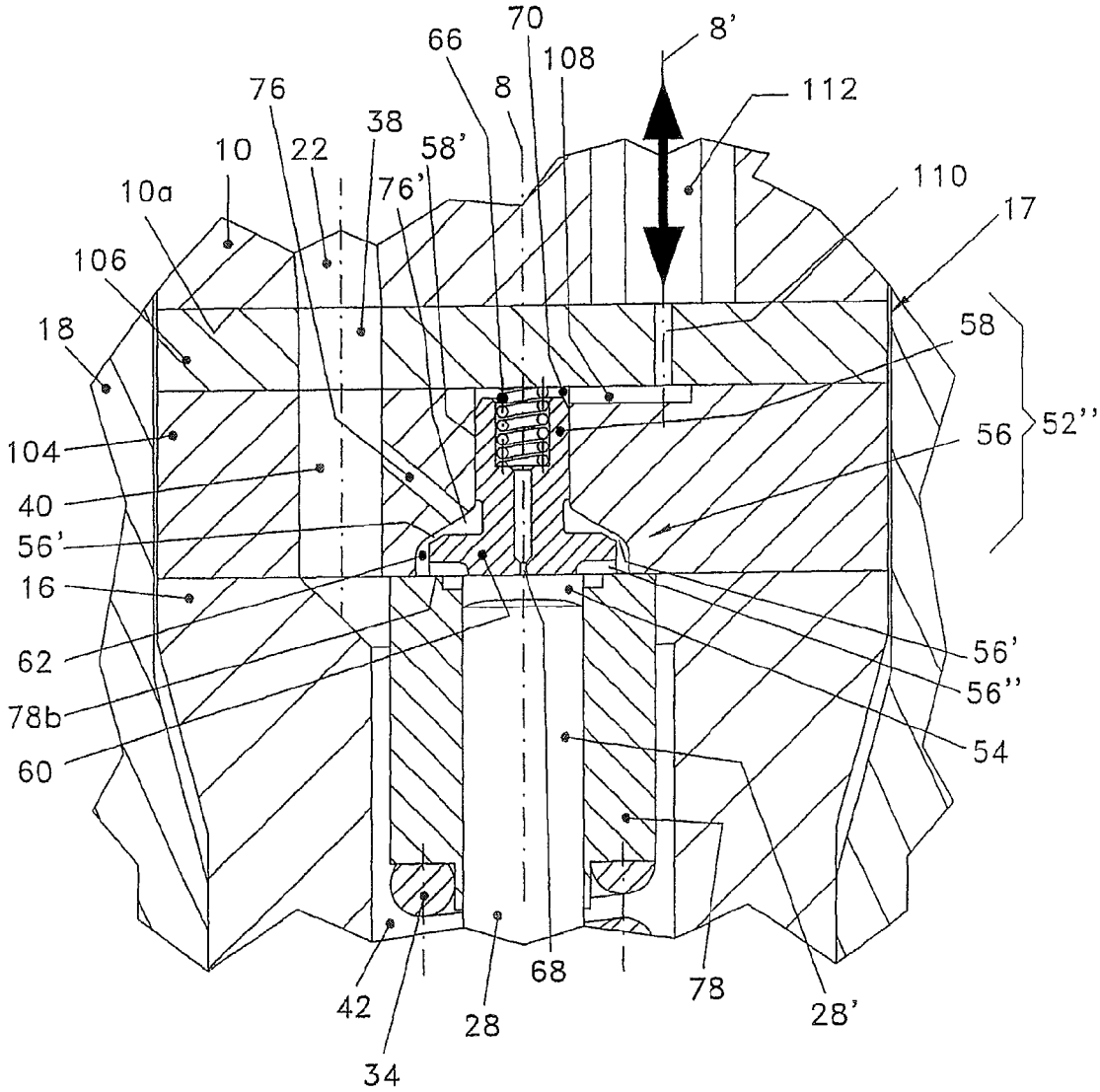
FIG. 5 shows, in longitudinal section and in an enlarged illustration, a partial section of a second alternative design variant of the control device of the fuel injection valve from FIG. 1.

FIG. 5 shows, in longitudinal section and in an enlarged illustration, a partial section of a second alternative design variant of the control device 52" of the fuel injection valve of FIG. 1. The second intermediate plate 106 has no valve space, but only an outlet passage 110 which is connected hydraulically to the rear side of the shank 58 of the intermediate valve member 56 via a passage 108 in the first intermediate plate 104, and once again the intermediate plates 104 and 106 forming the intermediate part 17 could be produced as a single workpiece. Alternatively, the passage 108 could also be manufactured in the second intermediate plate 106. The valve space 70 of FIG. 5 has a particularly small volume capacity. The cross section of the outlet passage 110 can be substantially larger than the cross section of the throttle passage 68. In the position shown in FIG. 5, the actuator shank 112 shuts off the outlet side of the outlet passage 110 such that no injection can take place. When the actuator shank 112 is moved away in the upward direction, the fuel pressure in the outlet passage 110 and in the passage 108 falls rapidly, so that, in a similar way to that described in connection with FIGS. 1 and 2, the fuel injection valve can inject. When the actuator shank 112 is moved in the direction of the outlet side of the outlet passage 110 again and said passage is closed, injection is terminated. The actuator for the actuator shank 112 may either by a piezoactuator or else an electromagnetic actuator which, when current is applied, attracts the actuator shank 112 in a known way.

Figure 6:
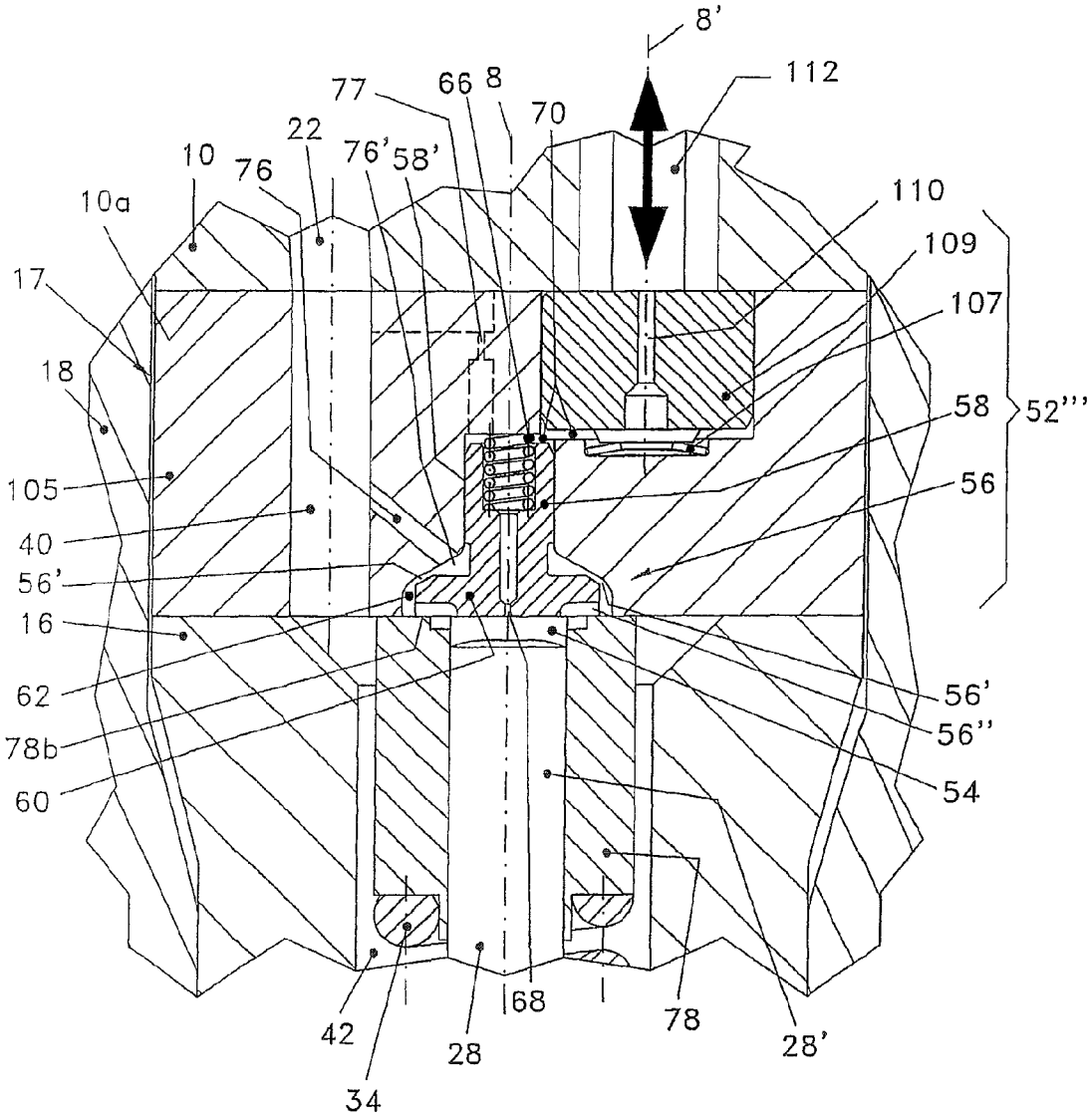
FIG. 6 shows, in longitudinal section and in an enlarged illustration, a partial section of a third alternative design variant of the control device of the fuel injection valve of the present invention.

FIG. 6 shows, in longitudinal section and in an enlarged illustration, a partial section of a third alternative design variant of the control device 52''' of the fuel injection valve 1. The two intermediate plates 104 and 106 of the embodiment according to FIG. 5 are replaced by a single intermediate plate 105; this forms the intermediate part 17. An outlet element 109 is located, coaxially with the axially offset axis 8', in a recess of the intermediate plate 105 and is pressed by a cup spring 107 and by the fuel pressure in the valve space 70 sealingly into bearing contact against the lower face 10*a* of the housing body 10 or, alternatively, of a supporting element not specified in any more detail. The outlet passage 110 is located in the outlet element 109. The advantages of this variant are the use of a single intermediate plate 105 instead of two intermediate plates 104 and 106 and the fact that the outlet element 109 which has small dimensions can be produced from a highly wear-resistant and even costly material in a cost-effective way.

Dashed lines in FIG. 6 show an alternative in which a throttle passage 77 connects the bore 40 to the small valve space 70. This causes a very rapid opening of the intermediate valve member 56 as soon as the outlet side of the outlet passage 110 is closed.

Figure 7:
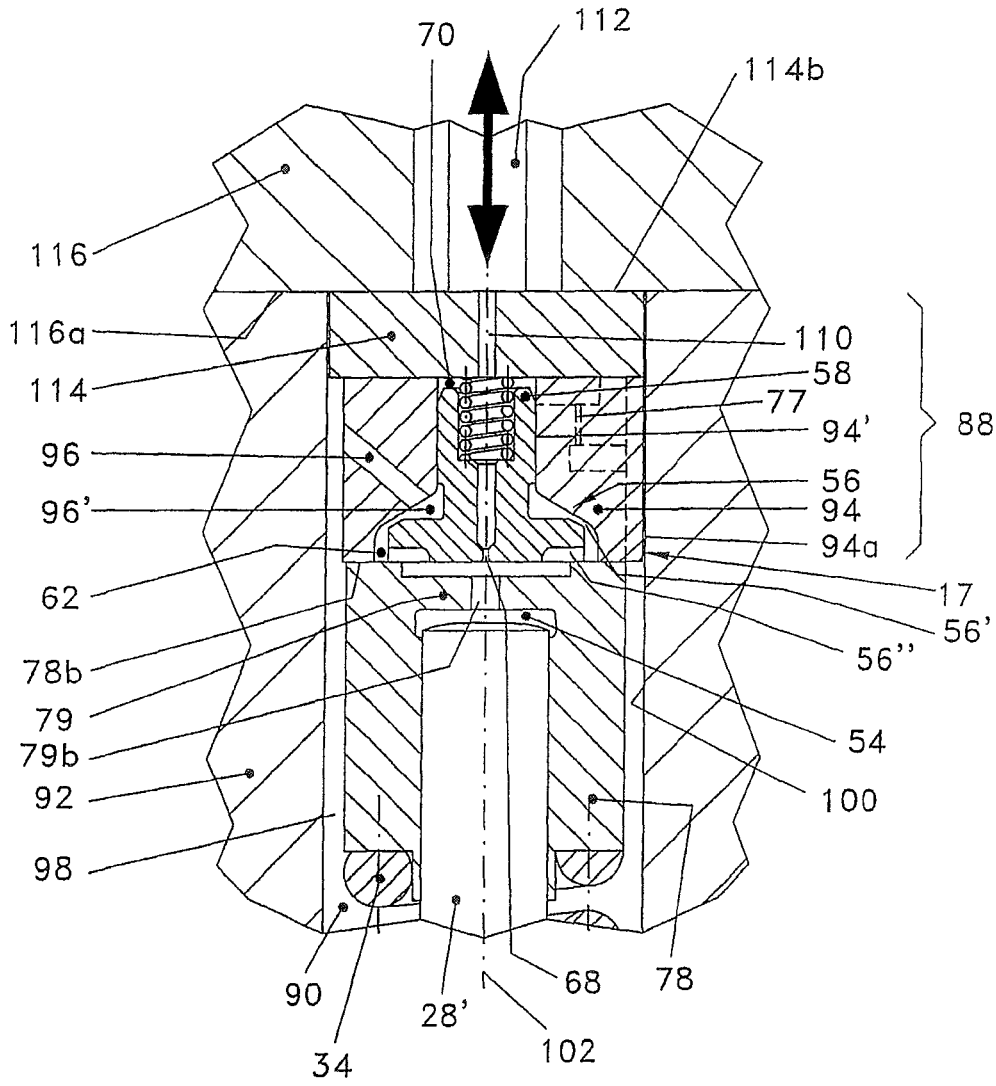
FIG. 7 shows, in longitudinal section and in an enlarged illustration, a partial section of a fourth alternative design variant of the control device of the fuel injection valve of the present invention.

FIG. 7 shows, in longitudinal section and in an enlarged illustration, a partial section of a fourth alternative design variant of the control device 88 of the fuel injection valve, in which the mushroom-shaped intermediate valve member 56 is designed in a similar way to FIG. 4, 5 or 6. The control device 88 is located in a high-pressure space 90 which has the same function as the high-pressure space 42 and which is manufactured in a body 92 surrounding the high-pressure space 90. The body 92 could be a nozzle body 16 or a housing body 10 or else an intermediate plate analogously or similarly to what is shown in FIGS. 1, 2, 4, 5 and 6. The control piston 28' of the injection valve member 28 projects into the high-pressure space 90, and the compression spring 34 presses the planar face 78*b* of the guide sleeve 78 into leaktight bearing contact against a lower end face 94*a* of an intermediate element 94 in which the mushroom-shaped intermediate valve member 56 is guided with a close sliding fit 94'. A bore 96 in the intermediate element 94 connects the clearance 62, in which the intermediate valve member 56 is located, and a groove 96' around the shank 58 of the intermediate valve member 56 to a passage 98 and therefore to the high-pressure space 90. The intermediate element 94 is provided instead of the first intermediate plate 12 of FIGS. 1, 2, 4 and 5 and is guided on the circumference with play by a radially inner wall 100 of the body 92 and is aligned axially with the longitudinal axis 102. The outlet passage 110 is located in a disk-shaped outlet element 114 which is positioned radially with play by the wall 100 in a similar way to the intermediate element 94. The top side 114*b* of the outlet element 114 on the underside 116*a* of a closing-off element 116, similar to the housing body 10, close off the high-pressure space 90 in a pressure-tight manner in the known way. The intermediate element 94 and the outlet element 114 form the intermediate part 17. In the embodiment according to FIG. 7, too, as in that according to FIG. 5, the volume capacity of the valve space 70 is very small. In the same way as in the embodiments according to FIG. 5 or 6, the end face of the shank 58 of the intermediate valve element 56 can be pressure-relieved and pressure-loaded by means of the actuation of the actuator shank 112 in order to implement intermittent diesel injections. The solution of FIG. 7 is advantageous when the control device 88 is installed in a space-saving way in a bore on the axis 102 of the fuel injection valve, and the intermediate plates 12, 14, 104, 105 and 106 of the preceding figures are dispensed with.

Alternatively, the intermediate element 94 and the outlet element 114 could be produced jointly in one piece. Alternatively, in a similar way to FIG. 6, the throttle passage 77 connects the high-pressure space 90 to the valve space 70, as is shown by dashes and acts in an equivalent way to FIG. 6.

Furthermore, the design of FIG. 7 has a mechanical stroke stop 79 for the end face of the control piston 28' of the injection valve member 28, said stroke stop being in the form of a projecting wall which is integral with the guide sleeve 78 and which projects into the control space 54 and is provided with a central passage 79*b* which connects the control space 54 hydraulically to the clearance 62. This embodiment or an embodiment of corresponding functioning could also be employed in the embodiments according to the other figures. Conversely, the embodiment shown in FIG. 7 could also be implemented without a mechanical stroke stop 79.

In an alternative variant, not shown, the solutions of FIG. 5 and FIG. 7 may be combined in such a way that all the elements of FIG. 7, apart from the disk-shaped outlet element 114, are located in the high-pressure space 90 on the longitudinal axis 102, but the outlet passage 110 is located on the axially offset actuator axis 8' in an intermediate plate similar to the second intermediate plate 106 of FIG. 5. A passage equivalent to the passage 108 of FIG. 5 must then run in this intermediate plate such that it makes no hydraulic connection to the high-pressure space 90 along its run from the end face of the shank 58 of the intermediate valve member 56 to the outlet passage 110. This is the case when the passage is designed, for example, as an oblique bore in this intermediate plate. The intermediate plate will then be thicker than illustrated in FIG. 5, so that the oblique inner run of the passage can be accommodated.

Figure 8:
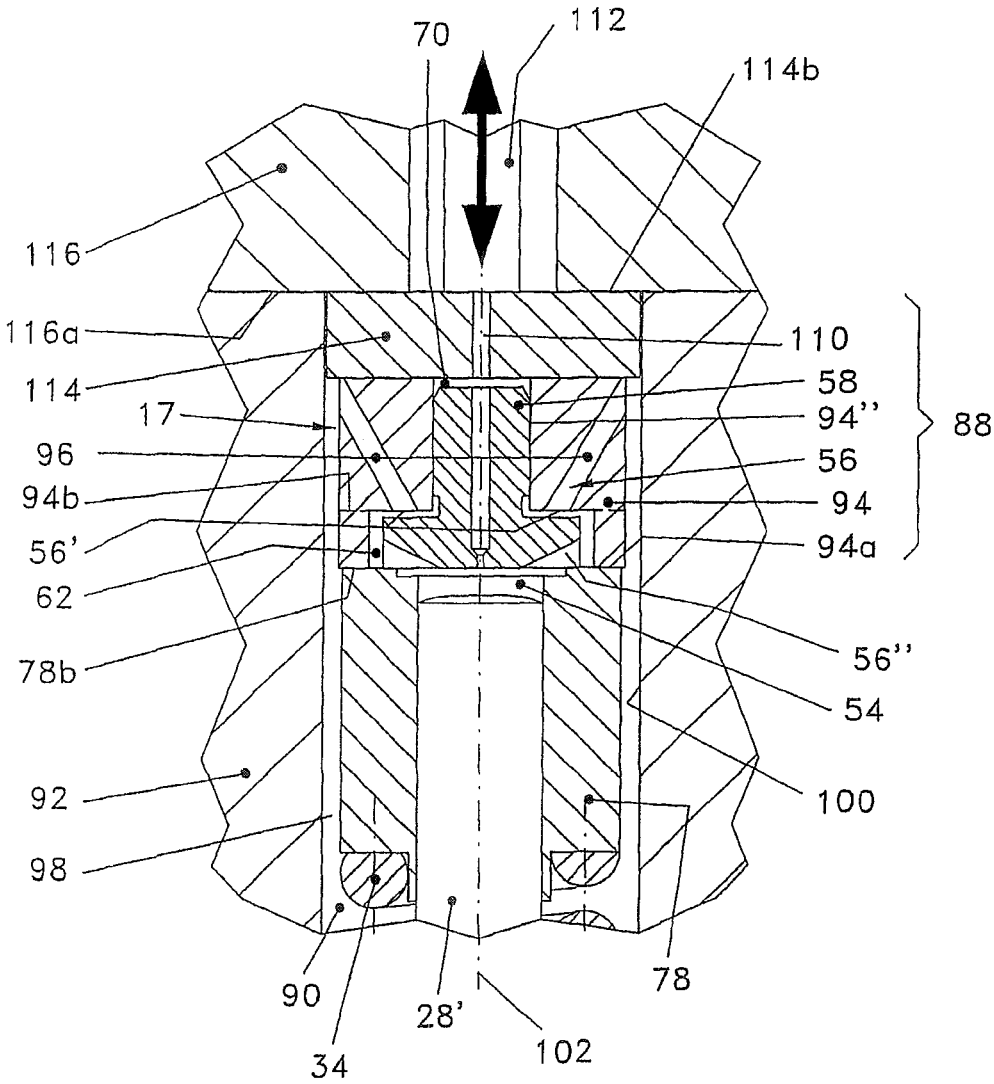
FIG. 8 shows, in longitudinal section and in an enlarged illustration, a partial section of a fifth alternative design variant of the control device of the fuel injection valve of the present invention.

FIG. 8 shows, in longitudinal section and in an enlarged illustration, a partial section of a fifth alternative design variant of the control device 88 of the fuel injection valve, said design variant being similar to that of FIG. 7. The mushroom-shaped intermediate valve member 56 has a flat seat, as shown in FIG. 2. However, there is no groove 76' present in the intermediate element 94. Two opposite bores 96 in the intermediate element 94 (there could also be one bore 96 or more than two bores 96) form with their open inlet into the clearance 62, together with the intermediate valve member 56, the intermediate valve 56'. When the intermediate valve member 56 closes off the bores 96 to allow intermittent injections, by virtue of this design the passage for the sliding fit 94" of the shank 58 is closed by the intermediate element 94 in addition to the passage into the clearance 62. If desired, this sliding fit 94" may be designed with less accuracy than that of the preceding design variants, and its play may amount to up to 50 micrometers instead of typically 2 to 6 micrometers of a close sliding fit, as in the embodiments according to FIG. 1 to 7. With a play of 50 micrometers, during the injection operation, the leakage from the groove 76' (FIG. 2) or from the corresponding point in the preceding figures into the valve space 70 would be very high, but, with the variant of FIG. 8, this does not occur because, in addition to the closing of the bores 96 by means of the intermediate valve 56', the sliding fit 94" is also separated from the high-pressure space 90. However, even in this variant, the sliding fit 94" must give rise to at least one such hydraulic separation point which brings about a sufficient pressure difference, so that, after the actuation of the actuator arrangement 24, the intermediate valve member 56 closes off the bores 96 very quickly. Moreover, the outlet of the bores 96 into the clearance 62 may be widened on the circumference around the axis 102, in order to obtain a larger throughflow area when the stroke of the intermediate valve member 56 is small. A kidney-shaped widening or a groove is then obtained, which runs in the circumferential direction of the clearance 62 and of the sliding fit 94" and which is surrounded by a flat seat. Furthermore, in contrast to that of the preceding figures, the control device 88 of FIG. 8 has no compression spring 66, and this may also be implemented in the preceding embodiments. The intermediate valve member 56 is then controlled solely by hydraulic forces.

An alternative separation point between the guide sleeve 78 and the intermediate element 94 is sketched at 94*b* by a dashed line. Alternatively, the intermediate element 94 and the outlet element 114 could be produced in one piece.

Figure 9:
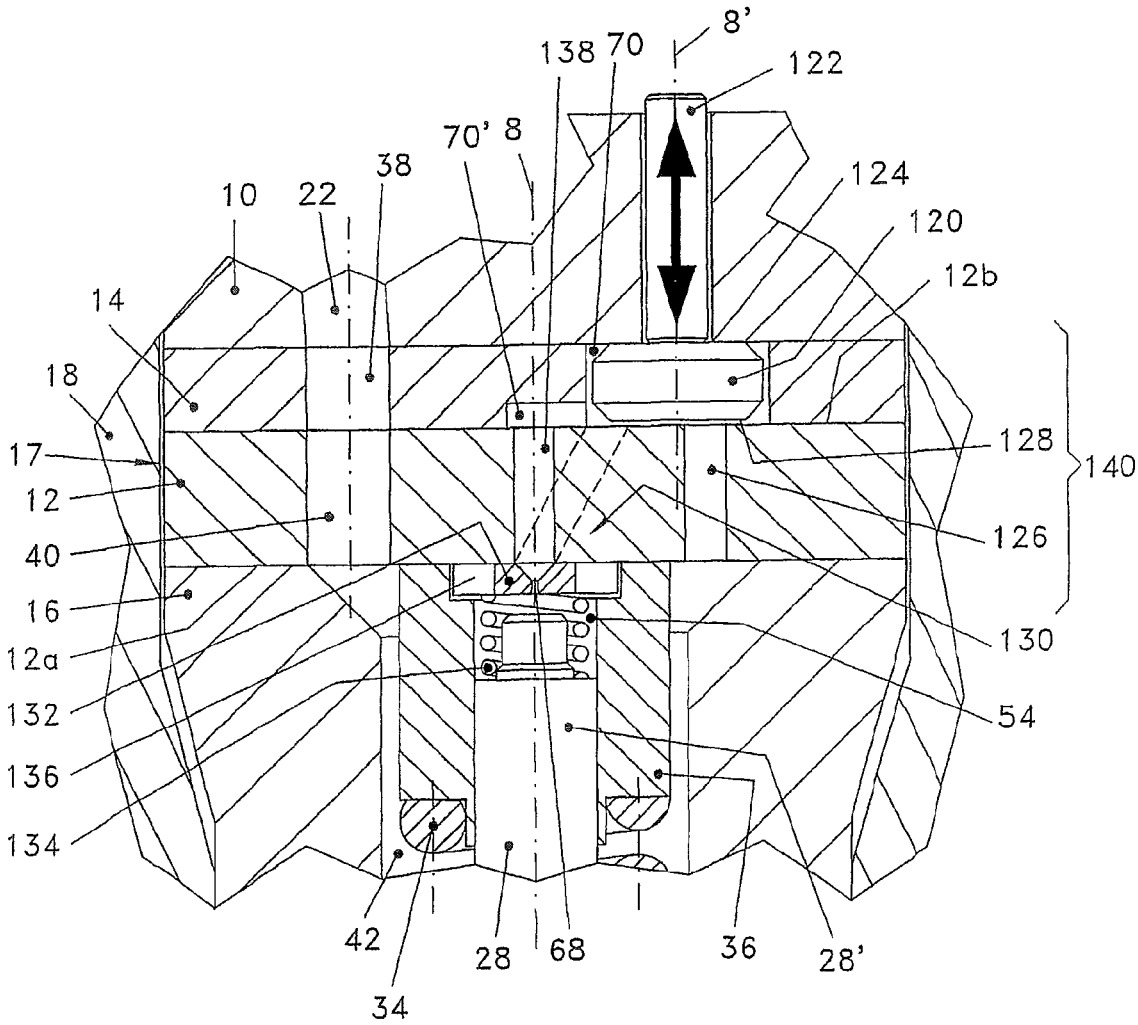
FIG. 9 shows, in longitudinal section and in an enlarged illustration, a partial section of a sixth alternative design variant of the control device of the fuel injection valve of the present invention.

FIG. 9 shows, in longitudinal section and in an enlarged illustration, a partial section of a sixth alternative design variant of a control device 140 of the fuel injection valve of the present invention.

Located in the second intermediate plate 14 is a pill-like flat-seat valve member 120 which acts as a 2/3-way valve and which can be moved by a valve pin 122 which can be actuated, for example, by a piezoactuator. The flat-seat valve member 120 can execute a specific small stroke in the second intermediate plate 14 between the housing body 10 and the first intermediate plate 12. In a preferred embodiment, the flat-seat valve member 120 has two flat seats, since it is thus particularly simple to obtain the specific small stroke by means of the difference in thickness of the second intermediate plate 14 and in thickness of the flat-seat valve member 120. In the de-energized state of the piezoactuator 26, the flat-seat valve member closes with a first valve seat 124 the connection between the valve space 70 and the low-pressure fuel return 50 (see FIG. 1) and at the same time releases a high-pressure duct 126 of relatively large unthrottled cross section which is located in the first intermediate plate 12 and is connected to the high-pressure space 42. The throughflow cross section between the flat-seat valve member 120 and the first intermediate plate 12, that is to say the second valve seat 128, releases, in the position of the flat-seat valve member 120 as shown, a cross section which is substantially larger, as compared with the throttle passage 68 of an intermediate wafer 132 forming a nonreturn valve 130. This may be achieved in that the high-pressure duct 126 defines per se a sufficiently large circumferential seat cross section with the valve seat 128 but a widening of the high-pressure duct 126 could also be formed in the region of the valve seat 128, the geometric configuration also always being substantially larger than the passage of the throttle passage 68 in order to give rise to a surface area at the valve seat 128.

The lateral passage 70' and a centric passage bore 138 in the first intermediate plate 12 of relatively large cross section connect the valve space 70 to the throttle passage 68 in the intermediate wafer 132, which has lateral clearances 136 and is pressed by a compression spring 134 against the lower face 12*a* of the first intermediate plate 12. During the opening movement of the injection valve member 28, the position of the intermediate wafer 132 is as shown in FIG. 9. As shown by dashes, the passage bore 138 could also be arranged obliquely, so that the passage 70' may be dispensed with.

The control device 140 functions as follows: for injection, the actuator arrangement presses the flat-seat valve member 120 from its position bearing on the first valve seat 124 onto the upper face 12*b* of the first intermediate plate 12 by means of the valve pin 122, thus opens the first valve seat 124 to the low-pressure outlet 50 and closes the second valve seat 128 to the high-pressure duct 126. As a result, the pressure in the valve space 70 and consequently also in the control space 54 falls. The injection valve member 28 can open, and the opening movement is controlled by the throttle passage 68. When the first valve seat 124 is closed as a result of the movement of the flat-seat valve member 120 in order to terminate injection, the second valve seat 128 opens at the same time. The fuel stream passing through relatively large cross sections into the valve space 70 and into the passage bore 138 opens the intermediate wafer in that the latter is pressed away from its bearing contact against the lower face 12*a*. The fuel stream passes via the clearances 132 into the control space 54 and the injection operation is terminated quickly. Thus, by the multiple actuation of the actuator arrangement, multiple injections with a very short time interval can be implemented. Alternatively, the intermediate plates 12 and 14 may be produced in one piece from one workpiece.

Figure 10:
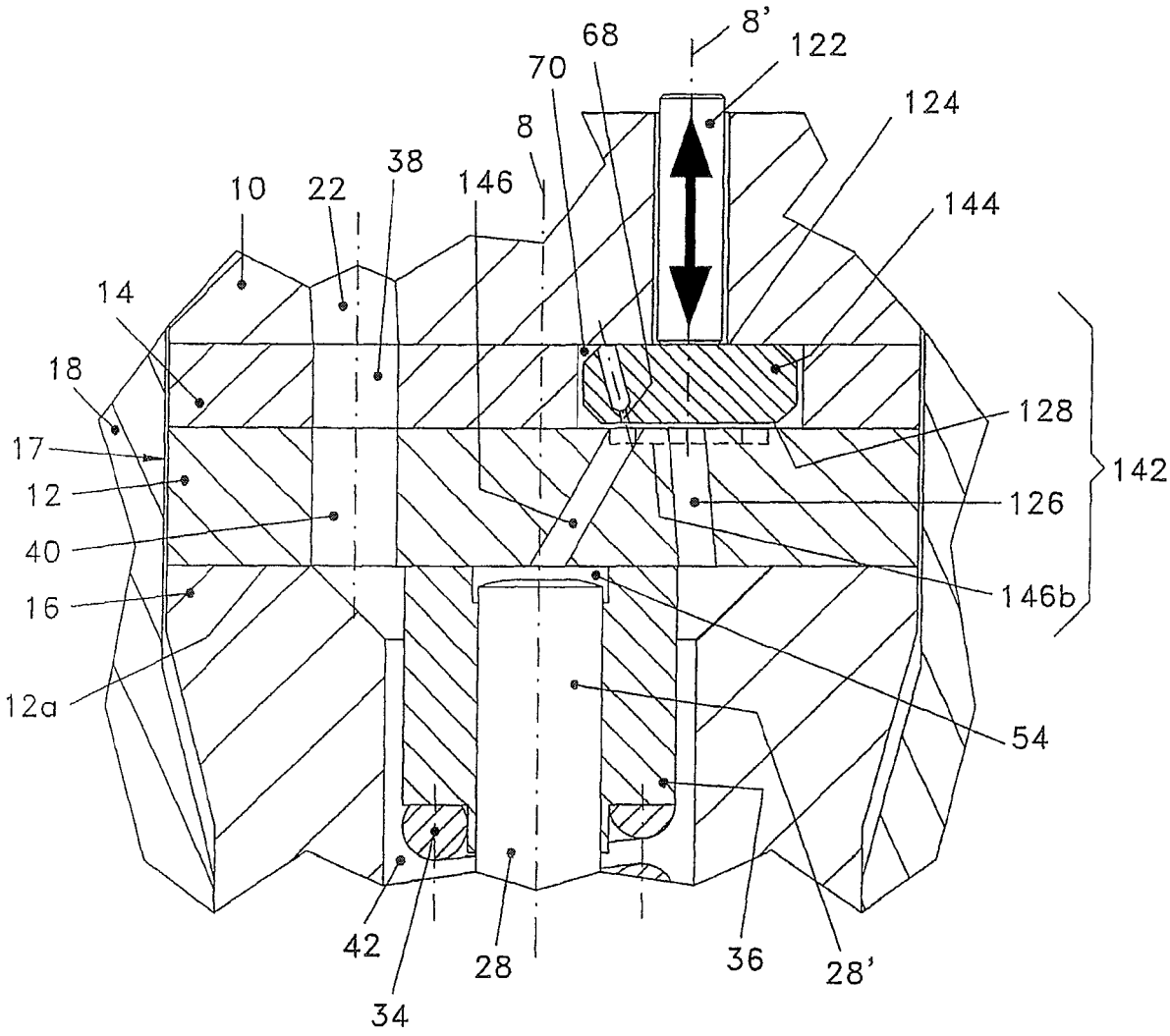
FIG. 10 shows, in longitudinal section and in an enlarged illustration, a partial section of a seventh alternative design variant of the control device of the fuel injection valve of the present invention.

FIG. 10 shows, in longitudinal section and in an enlarged illustration, a partial section of a seventh alternative design variant of the control device 142 of the fuel injection valve of the present invention, said design variant being similar to the version of FIG. 9.

The exact throttle passage 68 is located in the flat-seat valve member 144 and communicates via the passage bore 146 of relatively large cross section with the control space 54. In order to bridge the axial offset of the two longitudinal axes 8 and 8', it is advantageous if the passage bore 146 is arranged obliquely in the first intermediate plate 12, as shown. As illustrated in FIG. 10, the throttle passage 68 must be aligned with the passage bore 146. This is ensured if the flat-seat valve member 144 is not circular, but, instead, has, for example, laterally two chamfered faces or is oval or (rect)angular, in to be aligned fixedly in terms of rotation on the circumference with an associated guide shape of the valve space 70 of the second intermediate plate 14. Alternatively, a groove 146*b* (depicted by dashes) in the first intermediate plate 12 or the in the flat-seat valve member 144 could ensure the hydraulic connection in the case of a circular shape of the flat-seat valve member 144. Since the passage bore 146 and also a possible distance in the groove 14*b* are short, the effect of the changed position of the throttle passage 68 is functionally the same as if the throttle passage 68 were connected directly to the control space geometrically.

Here, too, the intermediate plates 12 and 14 could be combined into one workpiece.

The functioning of the control device 142 is similar to that of FIG. 9. The design is simpler, since the intermediate wafer 132 and the compression spring 134 are not required in FIG. 10.

Figure 11:
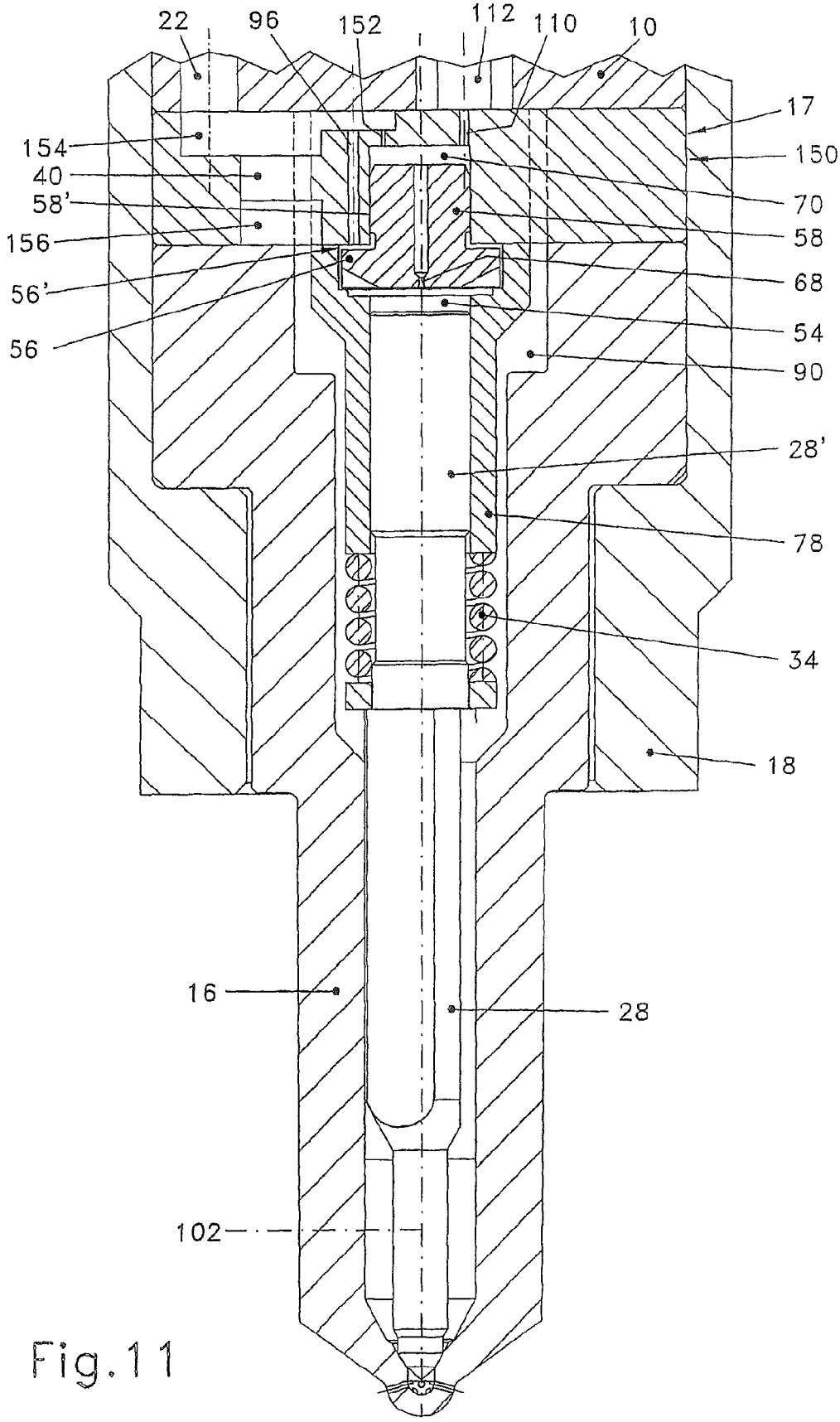
FIG. 11 shows, in the same illustration as FIG. 8, an alternative embodiment of the variant shown there.
Figure 12:
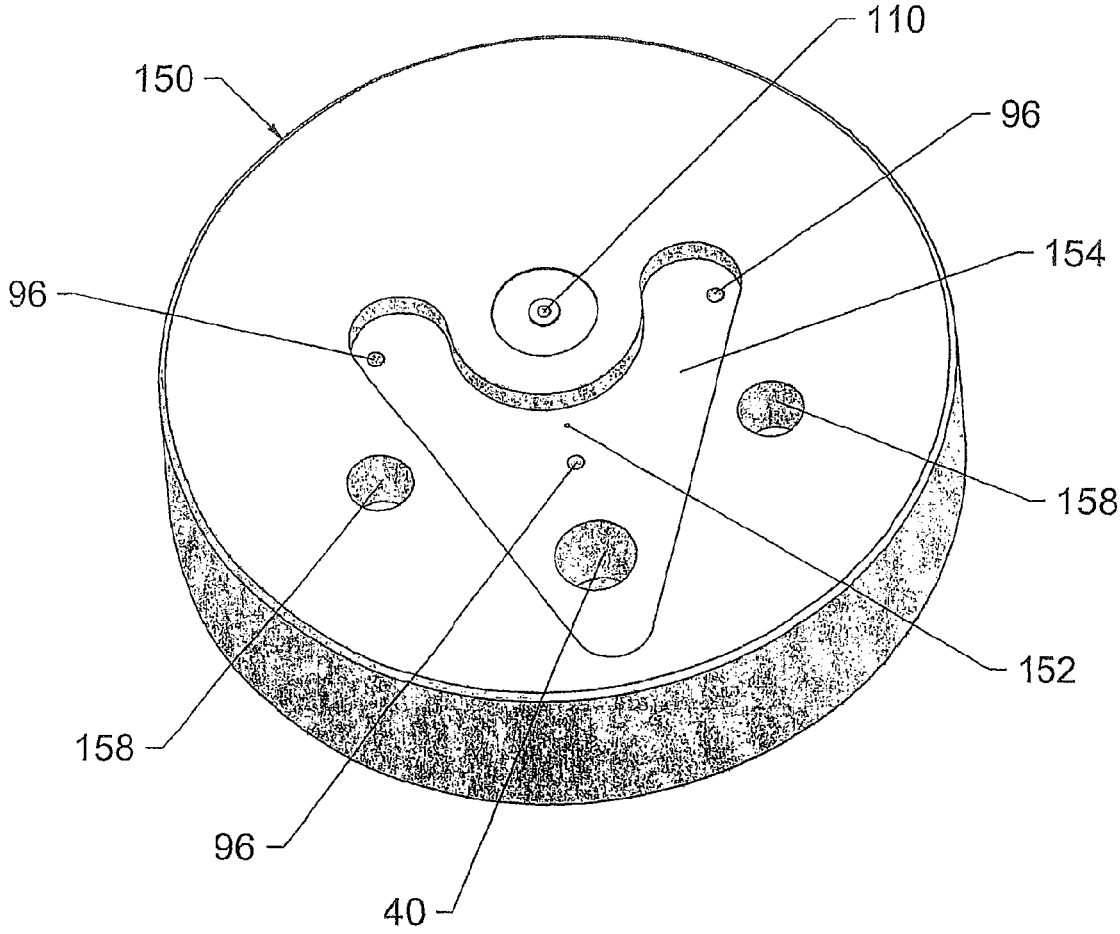
FIG. 12 shows, in a perspective top view, an intermediate body of the embodiment according to FIG. 11.
Figure 13:
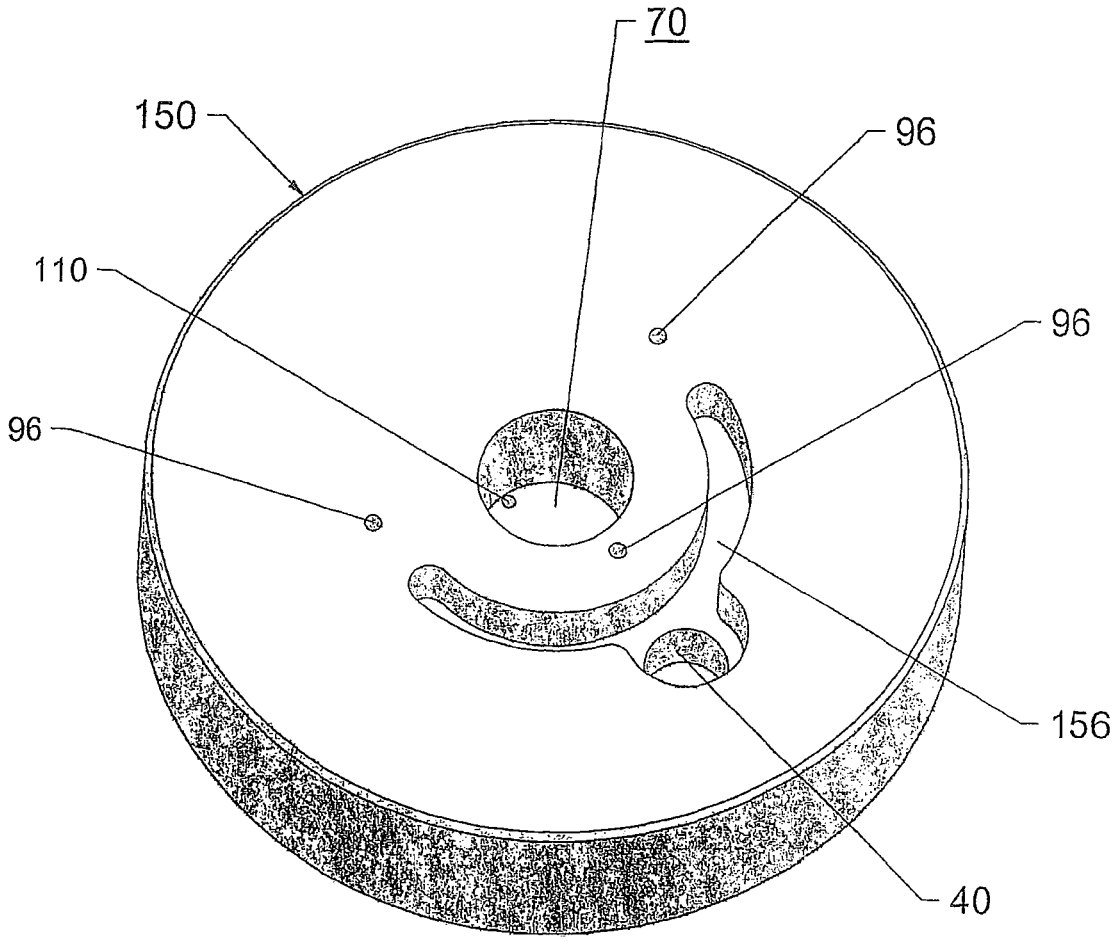
FIG. 13 shows the intermediate body in a perspective bottom view.

In the embodiment of the fuel injection valve according to the invention, as shown in FIG. 11, the intermediate element 94 and the outlet element 114 of the embodiment shown in FIG. 8 are combined into a single workpiece, an intermediate body 150. The disk-like intermediate body 150 forming the intermediate part 17 is held sealingly in bearing contact, on the one hand, against the nozzle body 16 and, on the other hand, against the housing body 10 by means of the tension nut 18. FIGS. 12 and 13 show, enlarged, the intermediate body 150.

A downwardly open blind hole-like recess in the intermediate body 150 forms with its circular-cylindrical surface area the sliding fit 58' with the shank 58 of the mushroom-like intermediate valve member 56 and with the shank 58 delimits the valve space 70. The latter is connected, on the one hand, via a very narrow admission bore 152 to the longitudinal bore 22 connected to the high-pressure inlet and, on the other hand, via the exact throttle passage 68 in the intermediate valve member 56 to the control space 54. Further, the outlet passage 110 leads, axially offset with respect to the longitudinal axis 102, from the valve space 70 to the passage in the housing body 10 in which the actuator shank 112 is arranged and which issues into the low-pressure return 50.

Three bores 96 run through the intermediate body 150 in the radial direction outside the centric blind hole-like recess and are flow-connected on the upper side to the longitudinal bore 22 by means of an essentially V-shaped connecting groove 154. They issue on the lower side into the control space 54 and can be closed by means of the head of the intermediate valve member 56.

Starting from the V-shaped connecting groove 154, the bore 40 runs in the axial direction through the intermediate body 150 and issues on the lower side into a U-shaped distribution groove 156 in the intermediate valve body 150. This distribution groove ensures the connection to the high-pressure space 90 radially outside the guide sleeve 78. By means of the compression spring 34, the guide sleeve 78 is held with its end face **78*b* in leaktight bearing contact against the intermediate body 150, the guide sleeve 78 bearing against the intermediate body 150 between the U-shaped distribution groove 156 and the mouth of the bores 96. In its end region on this side, the guide sleeve 78 is designed to be widened with respect to the region of the close sliding fit with the control piston 28' of the injection valve member 28, so that the head of the intermediate valve member 56** can be received with sufficient radial play.

Further, the intermediate body 150 has two blind hole-like positioning holes 158 into which positioning pins on the housing body 10 come into engagement.

As can be seen particularly from FIG. 12, the ring-like region which runs around the mouth of the outlet passage 110 and cooperates with the planar end face of the actuator shank 112 and which forms a valve seat may be produced in hardened form.

In a similar way to that described further above, dashed lines in FIG. 11 show a variant where the intermediate body 150 consists of two parts which are separated from one another.

In the state of rest, the actuator shank 112 closes the outlet passage 110, the injection valve member 28 bears against the injection valve seat 44 and the intermediate valve 56' is open; its head bears against an inner shoulder of the guide sleeve 78. To trigger an injection operation, the actuator shank 112 is retracted, thus leading to a pressure drop in the valve space 70 because the flow cross section of the outlet passage 110 is substantially larger than the sum of the flow cross sections of the throttle passage 68 and of the admission bore 152. The result of this is that the intermediate valve 56' closes and the pressure in the control space 54 therefore falls very quickly. The injection valve member 28 is lifted off from the injection valve seat 44 counter to the action of the compression spring 34 by the pressure drop in the control space 54. To terminate the injection operation, the outlet passage 110 is closed by means of the actuator shank 112. At least approximate pressure compensation occurs very quickly between the control space 54 and the valve space 70. Further, the high pressure prevailing in the bores 96 and, via the control piston 98', the compression spring 34 exert an opening force on the intermediate valve member 56, thus causing a very rapid closing movement of the injection valve member 28.

In a similar way to what was described further above, multiple injections are possible.

The embodiment indicated in FIG. 11 also functions without an admission bore 152. In this case, the opening of the intermediate valve 56' takes place with a slight delay.

In the exemplary embodiments shown the opening cross section of the outlet passage is at least twice as large as the cross section of the exact throttle passage 68.

Of course, the features of the control devices of the fuel injection valves of the present invention may also be used individually or in other combinations than those shown here.

The invention claimed is:

1. A fuel injection valve for intermittent injection of fuel into a combustion space of an internal combustion engine, the fuel injection valve comprising:

a housing which has a housing body and a nozzle body with an injection valve seat;

a high-pressure space which is arranged in the housing and which is connected to a high-pressure fuel inlet and to the injection valve seat;

an injection valve member which is arranged longitudinally adjustably in the housing and which cooperates with the injection valve seat;

a guide sleeve;

an intermediate part;

a compression spring which is supported, on the one hand, on the injection valve member and acts upon the injection valve member with a closing force directed toward the injection valve seat, and which is also supported, on the other hand, on the guide sleeve and at the same time presses the guide sleeve sealingly against the intermediate part;

a control space delimited with respect to the high-pressure space by the guide sleeve and a control piston of the injection valve member guided in the guide sleeve; and a control device for controlling axial movement of the injection valve member by varying a pressure in the control space;

wherein:

the control device comprises an intermediate valve, a valve space and an electrically actuated actuator arrangement for connecting the valve space to, and for separating the valve space from, a low-pressure fuel return;

the intermediate valve comprises an intermediate valve member, which, in the open position, releases a high-pressure admission into the control space and, in the closing position, cuts off the control space from the high-pressure admission;

the intermediate valve member separates the control space from the valve space, with the exception of a permanent connection by a throttle passage; and the intermediate valve member is of mushroom-shaped design, with its head configured to control the high-pressure admission, and which is guided with its shank with a sliding fit in the intermediate part to delimit the valve space and the control space.

2. The fuel injection valve as claimed in claim 1, wherein the high-pressure admission is formed by a passage leading into the control space and having a large cross section, as compared with the cross section of the throttle passage.

3. The fuel injection valve as claimed in claim 1, wherein the sliding fit is a close sliding fit.

4. The fuel injection valve as claimed in claim 1, wherein, in the open position, the intermediate valve has a substantially larger cross section than the cross section of the throttle passage.

5. The fuel injection valve as claimed in claim 1, wherein a flat seat cooperating with the intermediate valve member is formed on the intermediate part.

6. The fuel injection valve as claimed in claim 1, wherein a conical seat cooperating with the intermediate valve member is formed on the intermediate part.

7. The fuel injection valve as claimed in claim 1, wherein, in the closing position, the intermediate valve prevents passage of fuel from the high-pressure admission to the sliding fit.

8. The fuel injection valve as claimed in claim 1, wherein the intermediate valve member is constantly acted upon by a force of the compression spring in a direction of the open position.

9. The fuel injection valve as claimed in claim 1, wherein the actuator arrangement has an actuator valve member which, to open an outlet passage, is moved into the valve space and, by the move into the valve space, co-moves a piston element which reduces a volume of the control space, and which is moved in the opposite direction in order to close the outlet passage, the piston element reducing the volume of the valve space by bearing constantly against the actuator valve member.

10. The fuel injection valve as claimed in claim 1, wherein an outlet passage leads away from the valve space and is formed in a separate outlet element.

11. The fuel injection valve as claimed in claim 10, wherein the outlet passage, the intermediate valve member, the guide sleeve and the injection valve member are arranged on a longitudinal axis of the fuel injection valve.

12. A fuel injection valve for intermittent injection of fuel into a combustion space of an internal combustion engine, with a housing which has a housing body and a nozzle body with an injection valve seat, with a high-pressure space which is arranged in the housing and which is connected to a high-pressure fuel inlet and to the injection valve seat, with an injection valve member which is arranged longitudinally adjustably in the housing and which cooperates with the injection valve seat, with a compression spring which is supported, on the one hand, on the injection valve member and acts upon the injection valve member with a closing force directed toward the injection valve seat, and which is also supported, on the other hand, on a guide sleeve and at the same time presses the guide sleeve sealingly against an intermediate part, the guide sleeve, together with a control piston guided in the guide sleeve, of the injection valve member, delimiting a control space with respect to the high-pressure space, and with a control device for controlling axial movement of the injection valve member by varying a pressure in the control space, with a valve member which controls a connection between a high-pressure admission and the control space, the control space and a valve space being connected permanently to one another, with an electrically actuated actuator arrangement for closing and releasing an outlet passage leading from the valve space to a low-pressure fuel return, and at least one throttle passage arranged between the control space and the outlet passage, wherein an opening cross section of the outlet passage in the case of a full stroke of the actuator arrangement is larger than a cross section of the single throttle passage, and in this case an opening movement of the injection valve member is controlled solely by the throttle passage.

13. The fuel injection valve as claimed in claim 12, wherein the opening cross section of the outlet passage is at least twice as large as the cross section of the throttle passage.

14. The fuel injection valve as claimed in claim 1, wherein the intermediate part has a nozzle body-side first intermediate plate and a housing body-side second intermediate plate bearing over a large area against said first intermediate plate, and the valve space is delimited circumferentially by the second intermediate plate and on the end face by the housing body and the first intermediate plate.

15. The fuel injection valve as claimed in claim 1, wherein the sliding fit is formed in the first intermediate plate.

16. The fuel injection valve as claimed in claim 1, wherein the actuator arrangement is arranged on an actuator axis axially offset with respect to a longitudinal axis.

17. The fuel injection valve as claimed in claim 12, wherein the intermediate part has a nozzle body-side first intermediate plate and a housing body-side second intermediate plate bearing over a large area against said first intermediate plate, the valve space is delimited circumferentially by the second intermediate plate and on the end face by the housing body and the first intermediate plate, and the valve member is arranged in the valve space and is designed as a flat-seat valve member which controls a first flat-seat valve connected to the low-pressure fuel return and an opposite second flat-seat valve connected to the high-pressure space.

18. The fuel injection valve as claimed in claim 17, wherein the first and the second flat-seat valves, together with the common valve member, form a 2/3-way-valve.

19. The fuel injection valve as claimed in claim 17, wherein a stroke of the valve member is defined by a difference in thickness of the valve member and of the second intermediate plate.

20. The fuel injection valve as claimed in claim 17, wherein the first intermediate plate has a high-pressure duct, which connects the high-pressure space to the second flat-seat valve, and a passage bore for the constant connection of the valve space to the control space.

21. The fuel injection valve as claimed in claim 17, wherein the throttle passage is located in the valve member.

22. The fuel injection valve as claimed in claim 1, wherein the actuator arrangement is configured to control a fuel flow into the low-pressure fuel return as a function of a stroke, and an opening movement of the injection valve member takes place more slowly in the case of a part stroke than in the case of a maximum stroke.

* * * * *